US008569965B2

(12) United States Patent
Uchimoto et al.

(10) Patent No.: US 8,569,965 B2
(45) Date of Patent: Oct. 29, 2013

(54) DRIVING CIRCUIT OF LIGHT EMITTING ELEMENT, LIGHT EMITTING DEVICE USING THE SAME, AND ELECTRONIC DEVICE

(75) Inventors: Daisuke Uchimoto, Kyoto (JP); Naoki Inoue, Kyoto (JP)

(73) Assignee: Rohm Co., Ltd. (JP)

( * ) Notice: Subject to any disclaimer, the term of this patent is extended or adjusted under 35 U.S.C. 154(b) by 136 days.

(21) Appl. No.: 13/315,348

(22) Filed: Dec. 9, 2011

(65) Prior Publication Data

US 2012/0146531 A1 Jun. 14, 2012

(30) Foreign Application Priority Data

Dec. 9, 2010 (JP) ..... 2010-274564
Dec. 10, 2010 (JP) ..... 2010-275970

(51) Int. Cl.
*H05B 37/02* (2006.01)

(52) U.S. Cl.
USPC ..... 315/224; 315/209 R

(58) Field of Classification Search
None
See application file for complete search history.

(56) References Cited

U.S. PATENT DOCUMENTS 7,723,922 B2 * 5/2010 Lee et al. ..... 315/210
8,058,810 B2 * 11/2011 Chen et al. ..... 315/209 R
2010/0156319 A1 * 6/2010 Melanson ..... 315/297

FOREIGN PATENT DOCUMENTS

JP 2006-114324 A 4/2006

* cited by examiner

*Primary Examiner* — Crystal L Hammond
(74) *Attorney, Agent, or Firm* — Cantor Colburn LLP

(57) ABSTRACT

The present disclosure provides a driving circuit of a light emitting element including a switching power source for supplying a driving voltage to a first terminal of the light emitting element to be driven and a current driver connected to a second terminal of the light emitting element for supplying a driving current to the light emitting element while a burst dimming pulse is being asserted.

9 Claims, 5 Drawing Sheets

DRIVING CIRCUIT OF LIGHT EMITTING ELEMENT, LIGHT EMITTING DEVICE USING THE SAME, AND ELECTRONIC DEVICE

CROSS-REFERENCE TO RELATED APPLICATIONS

This application is based upon and claims the benefit of priority from Japan Patent Application No. 2010-275970, filed on Dec. 10, 2010, and Japan Patent Application No. 2010-274564, filed on Dec. 9, 2010, the entire contents of which are incorporated herein by reference.

TECHNICAL FIELD

The present disclosure relates to a technique of driving a light emitting element.

BACKGROUND

Recently, a light emitting device using a light emitting element including a light emitting diode (LED) has been used as a backlight of a liquid crystal panel or a lighting system. FIG. 1 is a circuit diagram illustrating a configuration example of a light emitting device according to a comparison technique. A light emitting device 1003 includes a plurality of LED strings **1006_1~1006_*n*, a switching power source 1004, and a current driving circuit 1008**.

Each of the LED strings 1006 includes a plurality of LEDs connected in series. The switching power source 1004 boosts an input voltage Vin and supplies a driving voltage Vout to one end portion of the LED strings **1006_1~1006_*n***.

The current driving circuit 1008 includes current sources $CS_1$~$CS_n$ installed at the respective LED strings **1006_1~1006_*n*. The respective current sources CS supply a driving current ILED, which is based on target luminance, to the corresponding LED strings 1006**.

The switching power source 1004 includes an output circuit 1102 and a control IC 1100. The output circuit 1102 includes an inductor L1, a switching transistor M1, a rectifying diode D1, and an output capacitor C1. The control IC 1100 feedback-controls a duty ratio of ON/OFF operations of the switching transistor M1 such that the lowest one among voltages $V_{LED1}$~$V_{LEDn}$ (also called detection voltages) generated from each of cathode terminals of the LED strings **1006_1~1006_*n* is close to a target voltage Vref. As a result, an output voltage Vout from the switching power source 1004 is stabilized to (Vref+Vf). In this configuration, Vf indicates a forward voltage (voltage drop) of the LED strings 1006**.

In such a light emitting device 1003, to adjust the luminance of the LED strings 1006, the driving current ILED is often pulse width modulation (PWM)-controlled. More specifically, a PWM controller 1009 of the current driving circuit 1008 generates burst dimming pulses $PWM_1$~$PWM_n$, each having a duty ratio based on luminance, and controls switching of the current sources $CS_1$~$CS_n$ that correspond to the burst dimming pulses $PWM_1$~$PWM_n$, respectively. Such controlling is also referred to as burst dimming or burst controlling.

Such a light emitting device is generally known to have the following problems.

During a period in which the current source CS is in an OFF state, namely, during a turn-off period of the LED strings 1006, the detection voltage $V_{LED}$ is negated, so it is difficult to perform feedback controlling based on the detection voltage $V_{LED}$. Thus, the control IC 1100 adjusts the duty ratio of ON/OFF operations of the switching transistor M1 based on the detection voltage $V_{LED}$ during a period in which the current source CS is in an ON state, namely, during a turn-on period of the LED strings 1006.

Further, when the turn-on period of the LED strings 1006 is shortened, the period during which feedback controlling is valid is shortened. When the turn-on period becomes as short as a switching pulse of the switching transistor M1 of the switching power source, feedback by an error amplifier cannot be followed, degrading the driving voltage Vout. Therefore, during the turn-on period, the luminance of the LED strings 1006 is degraded or the LED strings 1006 may not emit light.

The applicant of the present disclosure notes that the above problems are not considered common general knowledge in the field of the present disclosure. In other words, the foregoing discussion was first made by the applicant of the present disclosure.

SUMMARY

The present disclosure provides some embodiments of a control circuit capable of restraining a switch in an output voltage when the turn-on time of burst dimming becomes as short as a switching pulse.

According to one embodiment of the present disclosure, there is provided a driving circuit of a light emitting element including a switching power source for supplying a driving voltage to a first terminal of the light emitting element to be driven and a current driver connected to a second terminal of the light emitting element for supplying a driving current to the light emitting element while a burst dimming pulse is being asserted.

The switching power source includes a capacitor in which a potential of one end is fixed and an error amplifier configured to supply a current depending on a difference between a detection voltage generated from the second terminal of the light emitting element and a reference voltage to the capacitor. The switching power source also includes a switch installed between an output terminal of the error amplifier and the capacitor and maintained in an ON state while the burst dimming pulse is being asserted, and a pulse generation unit configured to receive a feedback voltage generated in the capacitor and generate a switching pulse signal having a corresponding duty ratio. A driver of the switching power source is configured to drive a switching element of the switching power source based on the switching pulse signal. And a feedback voltage regulator circuit of the switching power source is configured to be switched between ON and OFF states based on a pulse width of the burst dimming pulse and supply a current to the capacitor when in an ON state.

In one embodiment, the feedback voltage regulator circuit is turned on when the pulse width of the burst dimming pulse is longer than a predetermined threshold value, turned on while the burst dimming pulse is being asserted when the pulse width of the burst dimming pulse is shorter than the threshold value, and then turned off.

In one embodiment, the driving circuit of the light emitting element further includes a short detection comparator configured to generate a short detection signal asserted when the detection voltage is higher than a predetermined threshold voltage. The feedback voltage regulator circuit is turned off when the short detection signal is being asserted at a timing when the burst dimming pulse is negated.

In one embodiment, the feedback voltage regulator circuit includes a flipflop having an input terminal to which the short detection signal is input and a clock terminal to which an inverted signal of the burst dimming pulse is input, and wherein an ON/OFF state of the feedback voltage regulator circuit is switchable depending on an output signal from the corresponding flip-flop.

In one embodiment, the feedback voltage regulator circuit is turned on when the short detection signal is asserted while the burst dimming pulse is being negated.

In one embodiment, the feedback voltage regulator circuit includes an NAND gate configured to receive the burst dimming pulse and an inverted signal of the short detection signal and a flipflop having an input terminal to which the short detection signal is input, a clock terminal to which an inverted signal of the burst dimming pulse is input, and a reset terminal to which an output signal from the NAND gate is input. An ON/OFF state of the feedback voltage regulator circuit is switchable depending on an output signal from the corresponding flip-flop.

In one embodiment, the feedback voltage regulator circuit includes a current source configured to supply a current to the capacitor when in an ON state.

According to another embodiment of the present disclosure, there is provided a light emitting device including a light emitting element and a driving circuit as described above for driving the light emitting element.

According to another embodiment of the present disclosure, there is provided an electronic device including a liquid crystal panel and a light emitting device as described in above as a backlight of the liquid crystal panel.

DETAILED DESCRIPTION

Figure 1:
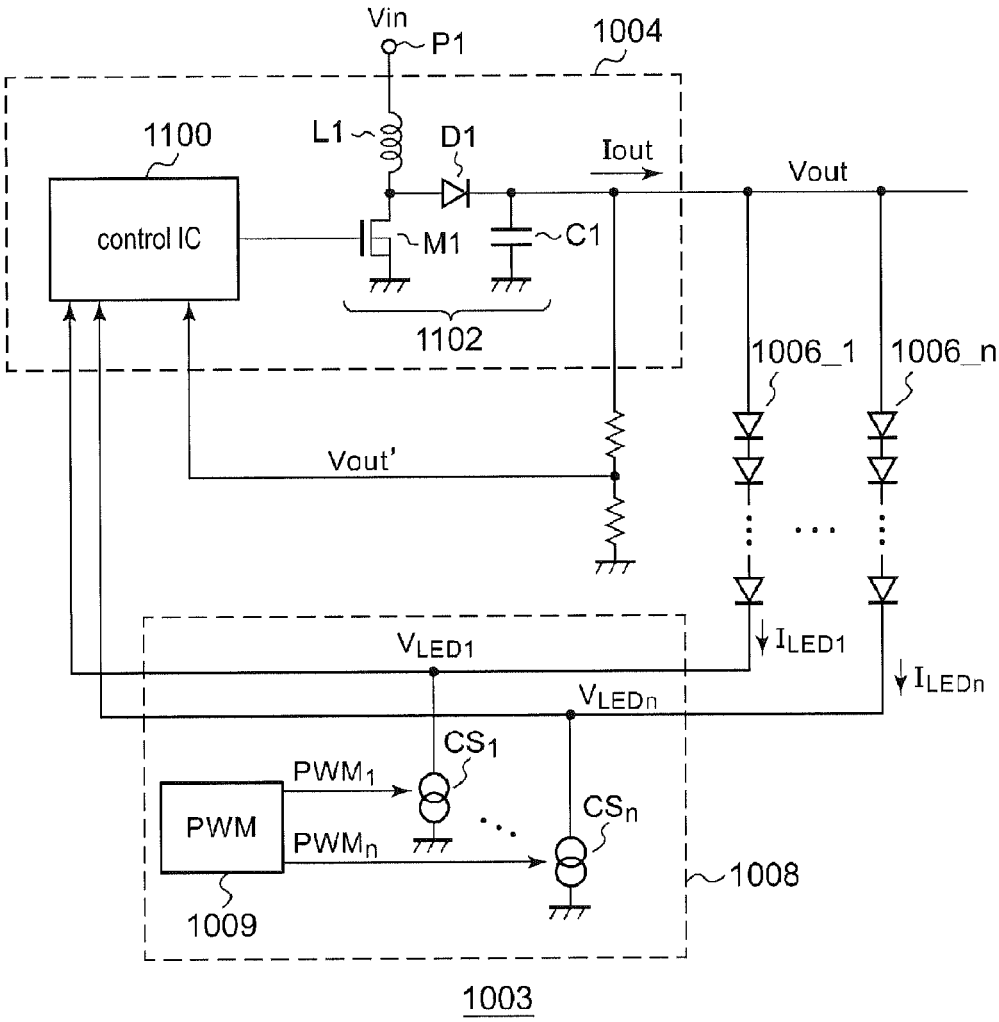
FIG. 1 is a circuit diagram showing a configuration example of a light emitting device according to a comparison technique.

An embodiment of the present disclosure will now be described in detail based on appropriate embodiments with reference to the drawings. The same reference numerals are used for the same or equivalent components, members, and processing illustrated in respective drawings, and repeated descriptions are aptly omitted. Also, an embodiment of the present disclosure is merely illustrative, rather than limiting the present disclosure, and any features or combination thereof described in the embodiment are not necessarily considered to be essential.

In the present disclosure, a "state in which member A is connected with member B" also includes a case in which member A and member B are indirectly connected through a different member that does not affect an electrical connection state, besides a case in which member A and member B are physically directly connected. Similarly, a "state in which member C is installed between member A and member B" also includes a case in which member C is indirectly connected to member A and member B through a different member that does not affect an electrical connection state, besides a case in which member A and member C or member B and member C are directly connected.

Figure 2:
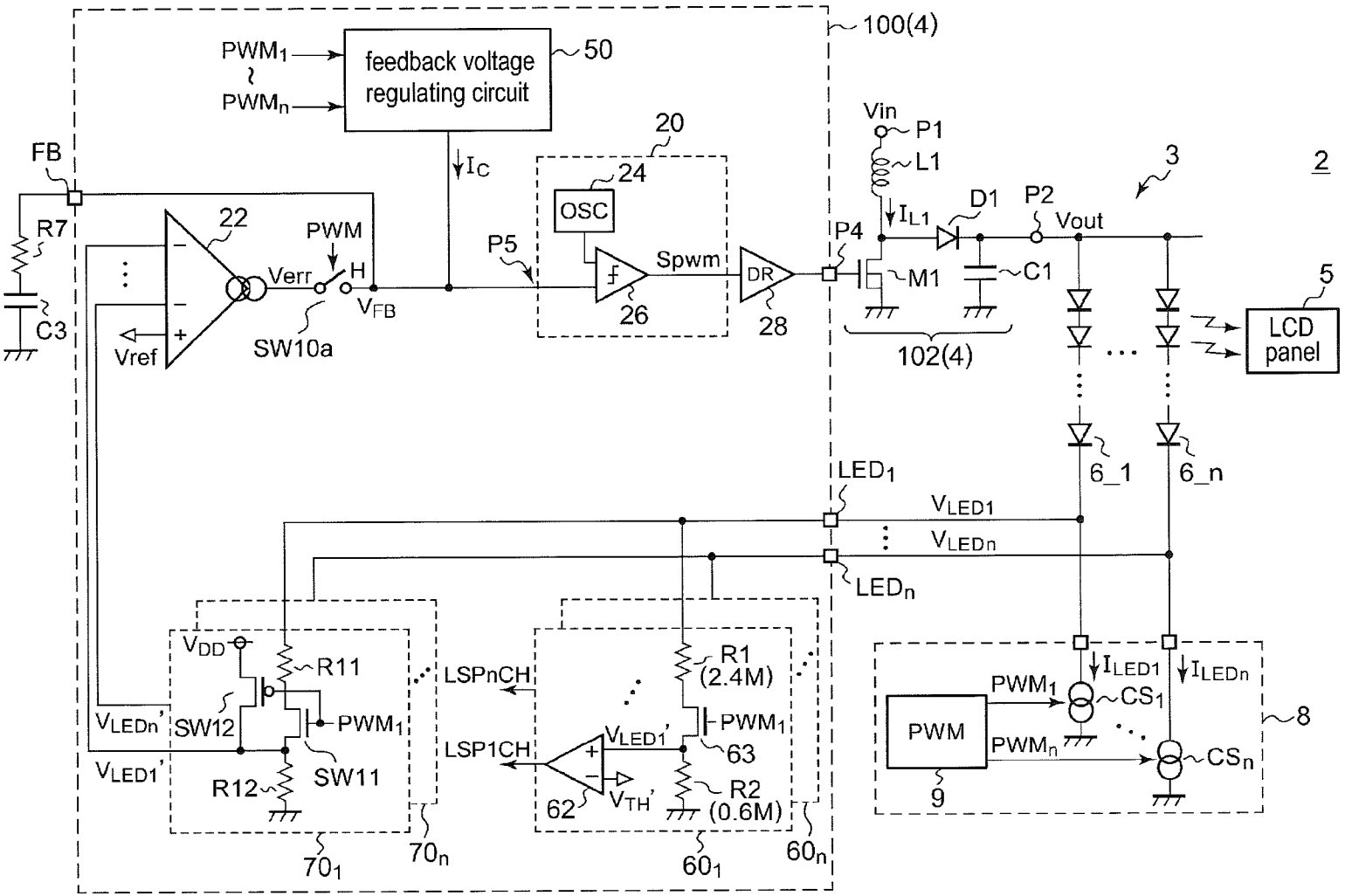
FIG. 2 is a circuit diagram showing a configuration of an electronic device including a light emitting device according to an embodiment of the present disclosure.

FIG. 2 is a circuit diagram showing the configuration of an electronic device including a light emitting device according to an embodiment of the present disclosure.

An electronic device 2 is a battery-driven device such as a notebook PC, a digital camera, a digital video camera, a mobile phone terminal, a personal digital assistant (PDA), or the like, and includes a light emitting device 3 and a liquid crystal display (LCD) panel 5. The light emitting device 3 is installed as a backlight of the LCD panel 5.

The light emitting device 3 includes LED strings **6_1~6_*n* as light emitting elements, a current driving circuit 8, and a switching power source 4. The current driving circuit 8 and the switching power source 4** constitute a driving circuit of the light emitting strings.

The respective LED strings 6 include a plurality of LEDs connected in series. The switching power source 4, which is a boost type DC/DC converter, boosts an input voltage (e.g., a battery voltage) Vin which is input to an input terminal P1 and outputs an output voltage (driving voltage) Vout from an output terminal P2. One end (anode) of each of the plurality of LED strings **6_1~6_*n* is commonly connected to the output terminal P2**.

The switching power source 4 includes a control IC 100 and an output circuit 102. The output circuit 102 includes an inductor L1, a rectifying diode D1, a switching transistor M1, and an output capacitor C1. The topology of the output circuit 102 is general, so a description thereof will be omitted. Also, a person skilled in the art will understand that the topology may be variably modified and thus the present disclosure is not limited thereto.

A switching terminal P4 of the control IC 100 is connected to a gate of the switching transistor M1. The control IC 100 adjusts the duty ratio of ON/OFF operations of the switching transistor M1 through feedback such that an output voltage Vout required for turning on the LED strings 6 can be obtained. Also, the switching transistor M1 may be installed in the control IC 100.

The current driving circuit 8 is connected to the other ends (cathodes) of the plurality of LED strings **6_1~6_*n*. The current driving circuit 8 supplies an intermittent driving current $I_{LED1}$~$I_{LEDn}$ based on target luminance to each of the LED strings 6_1~6_*n*, respectively. More specifically, the current driving circuit 8 includes a plurality of current sources $CS_1$~$CS_n$, installed for each of the LED strings 6_1~6_*n*, respectively, and a PWM controller 9. An ith current source $CS_i$ is connected to a cathode of a corresponding ith LED string 6_*i*. The current source $CS_i$ is configured to be switched over between an operation (active) state $\phi_{ON}$ in which a driving current $I_{LEDi}$ is output and an off state $\phi_{OFF}$ in which the driving current $I_{LEDi}$ is stopped, depending on a burst dimming pulse $PWM_i$ output from the PWM controller 9. The PWM controller 9 generates burst dimming pulses $PWM_1$~$PWM_n$, each having a duty ratio based on target luminance, and outputs the generated burst dimming pulses $PWM_1$~$PWM_n$ to the current sources $CS_1$~$CS_n$, respectively. While the burst dimming pulse $PWM_i$ is being asserted (e.g., high level), that is, turn-on period $T_{ON}$, the corresponding current source $CS_i$ is in an operational state $\phi_{ON}$ and the LED string 6_*i* is turned on. While the burst dimming pulse $PWM_i$ is being negated (e.g., low level), that is, turn-off period $T_{OFF}$, the corresponding current source $CS_i$ is in an off state $\phi_{OFF}$ and the LED string 6_*i* is turned off. By controlling a time ratio between the turn-on period $T_{ON}$ and the turn-off period $T_{OFF}$, an effective value (average value in time base) of the driving current $I_{ILEDi}$ flowing across the LED string 6_*i* is controlled, thus adjusting luminance. The frequency of the PWM driven by the current driving circuit 8** ranges from tens to hundreds Hz. Hereinafter, the burst dimming pulses $PWM_1$~$PWM_n$ are assumed to transition at the same timing and those pulses are generally called burst dimming pulses PWM.

The control IC 100 and the current driving circuit 8 may be integrated in a single semiconductor chip or integrated in separate chips. They may configure a single package (module) or may configure separate packages.

An overall configuration of the light emitting device 3 has been described. A configuration of the control IC 100 will now be described. The control IC 100 includes LED terminals $LED_1$~$LED_n$ installed at the respective LED strings **6_1~6_*n*. Each LED terminal $LED_i$ is connected to a cathode terminal of a corresponding LED string 6_*i***. Also, a plurality of LED strings may not be provided and instead only one LED string may be provided.

The control IC 100 largely includes an error amplifier 22, a first switch SW10*a*, a pulse generation unit 20, a driver 28, short detection circuits $\mathbf{60}_1$~$\mathbf{60}_n$, and feedback circuits $\mathbf{70}_1$~$\mathbf{70}_n$.

A phase compensation resistor R7 and a phase compensation capacitor C3 are installed between an FB terminal and an external fixed voltage terminal (earth terminal).

The feedback circuits $\mathbf{70}_1$~$\mathbf{70}_n$ are installed at LED terminals (channels) $LED_1$~$LED_n$, respectively. An ith feedback circuit $\mathbf{70}_i$ outputs a voltage $V_{LED1'}$ depending on a detection voltage $V_{LEDi}$ from a corresponding LED terminal $LED_i$ to the error amplifier 22. More specifically, the feedback circuit $\mathbf{70}_i$, which is a voltage divider including resistors R11 and R12, divides the detection voltage $V_{LEDi}$ by a division ratio K1. A first switch SW11 is turned on while a burst dimming pulse $PWM_i$ of a corresponding channel is being asserted (turn-on period) and turned off while the burst dimming pulse $PWM_i$ is being negated (turn-off period). Also, the first switch SW11 of an ith channel is turned off when the channel is excluded from a feedback target. For example, the first switch SW11 is an N channel MOSFET controlled based on the burst dimming pulse $PWM_i$. A second switch SW12 is turned on when the channel should be excluded from the feedback target and pulls up a detection voltage $V_{LEDi'}$, for example, to a power source voltage $V_{DD}$. Accordingly, the detection voltage $V_{LEDi'}$ of the channel can become higher than a detection voltage $V_{LEDj'}$ (where j≠i) of a different channel, thus being excluded from feedback. Also, dividing of the detection voltage is not a fundamental processing, so in the following description, $V_{LED'}$ and $V_{LED}$ will not be distinguished if not particularly necessary. For example, the second switch SW12 is a P channel MOSFET controlled based on the burst diming signal $PWM_i$.

The error amplifier 22, which is a so-called gm (transconductance) amplifier, generates a current depending on a difference between the detection voltage $V_{LED}$ and a reference voltage Vref during the turn-on period of the LED string 6 and supplies the generated current to the FB terminal. A feedback voltage $V_{FB}$ is generated based on the difference between the detection voltage $V_{LED}$ and a reference voltage Vref at the FB terminal.

More specifically, the error amplifier 22 includes a plurality of inverting input terminals (−) and one non-inverting input terminal (+). Detection voltages $V_{LED1}$~$V_{LEDn}$ are input to the plurality of inverting input terminals, respectively, and the reference voltage is input to the non-inverting input terminal. The error amplifier 22 outputs a current depending on the difference between the lowest detection voltage $V_{LED}$ and the reference voltage Vref.

The first switch SW10*a* is installed between an output terminal of the error amplifier 22 and the FB terminal. The first switch SW10*a* is turned on while the burst dimming pulse PWM is being asserted, namely, during a turn-on period $T_{ON}$, and turned off while the burst dimming pulse PWM is being negated, namely, during a turn-off period $T_{OFF}$. In the case where the phases of the burst diming pulses $PWM_1$-$PWM_n$ with respect to the plurality of current sources $CS_1$~$CS_n$ are shifted, the first switch SW10*a* is turned on while at least one burst dimming pulse PWM is being asserted.

The pulse generation unit 20, which is, for example, a pulse width modulator, receives the voltage $V_{FB}$ generated from the FB terminal and generates a switching pulse signal Spwm having a corresponding duty ratio. More specifically, as the feedback voltage $V_{FB}$ has a higher level, the duty ratio of the switching pulse signal Spwm is increased. The pulse generation unit 20 includes an oscillator 24 and a PWM comparator 26. The oscillator 24 generates a periodic voltage Vosc having a triangular wave or a sawtooth wave.

The PWM comparator 26 compares the feedback voltage with the periodic voltage Vosc and generates a PWM signal Spwm having a level based on the comparison result. Also, a pulse frequency modulator or the like may be used as the pulse generation unit 20. The frequency of the PWM signal Spwm is hundreds of kHz (e.g., 600 kHz), which is sufficiently high in comparison to the frequency of the PWM driven by the current driving circuit 8.

The driver 28 drives the switching transistor M1 of the switching power source 4 based on the switching pulse signal Spwm.

The short detection circuits $\mathbf{60}_1$~$\mathbf{60}_n$ are installed at every channel of the LED strings **6_1~6_*n***, and configured in the same manner. A short detection circuit $\mathbf{60}_i$ generates a short detection signal LSPiCH asserted when the detection voltage $V_{LEDi}$ of the LED terminal is higher than a certain threshold value voltage $V_{TH}$ during the turn-on period $T_{ON}$. During the turn-off period $T_{OFF}$, a short detection is invalidated.

The short detection circuit 60*i* includes a short detection comparator 62, resistors R1 and R2, and a transistor 63.

The detection voltage $V_{LEDi}$ of the LED terminal is divided by the resistors R1 and R2. When R1=2.4 MΩ, and R2=0.6 MΩ, the division ratio is β=1/5. The transistor 63, which is controlled in synchronization with the burst dimming pulse $PWM_i$, is turned on during the turn-on period $T_{ON}$ and turned off during the turn-off period $T_{OFF}$. The short detection comparator 62 compares the detection voltage $V_{LEDi'}$ divided by the resistors R1 and R2 with a threshold voltage $V_{TH'}$ during the turn-on period $T_{ON}$, and outputs a short detection signal LSPiCH having a high level (asserted) when $V_{LEDi}>V_{TH'}$. Here, the following equation is established:

$$V_{TH'}=V_{TH}\times\beta$$

A feedback voltage regulator circuit 50 is configured to be switched between ON and OFF states depending on a pulse width of the burst dimming pulse PWM, and when the feedback voltage regulator circuit 50 is turned on, it supplies a current $I_C$ to the phase compensation capacitor C3, and when the feedback voltage regulator circuit 50 is turned off, it stops current supply to the phase compensation capacitor C3.

When the pulse width of the burst dimming pulse PWM is longer than a certain threshold value, the feedback voltage regulator circuit 50 is turned on during both the turn-on period and turn-off period. Also, when the pulse width of the burst dimming pulse PWM is shorter than the threshold value, the feedback voltage regulator circuit 50 is turned off when the turn-on period is terminated.

The current $I_C$ is injected when the feedback voltage regulator circuit 50 is in an ON state, thereby changing the feedback voltage $V_{FB}$ such that the turn-on period of the switching transistor M1 is lengthened. To be more specific, the feedback voltage regulator circuit 50 increases the feedback voltage $V_{FB}$ in an ON state to thus lengthen the turn-on time of the switching transistor M1.

It is desirable that the injection current $I_C$ is smaller than a source current or sync current of the error amplifier 22. For example, when the source current or sync current is a maximum 100 μA, the injection current $I_C$ of the feedback voltage regulator circuit 50 is preferably about 1 μA.

More specifically, the feedback voltage regulator circuit 50 transitions from an ON state to an OFF state when the following conditions are met. It is assumed that the detection voltage $V_{LEDi}$ of the ith channel is fed back. Here, the feedback voltage regulator circuit 50 is turned off when the short detection signal LSPiCH is asserted at a timing at which the burst dimming pulse $PWM_i$ transitions from assertion to negation.

Thereafter, when the short detection signal LSPiCH is asserted while the burst dimming pulse $PWM_i$ is being negated, the feedback voltage regulator circuit 50 is turned on.

Figure 3:
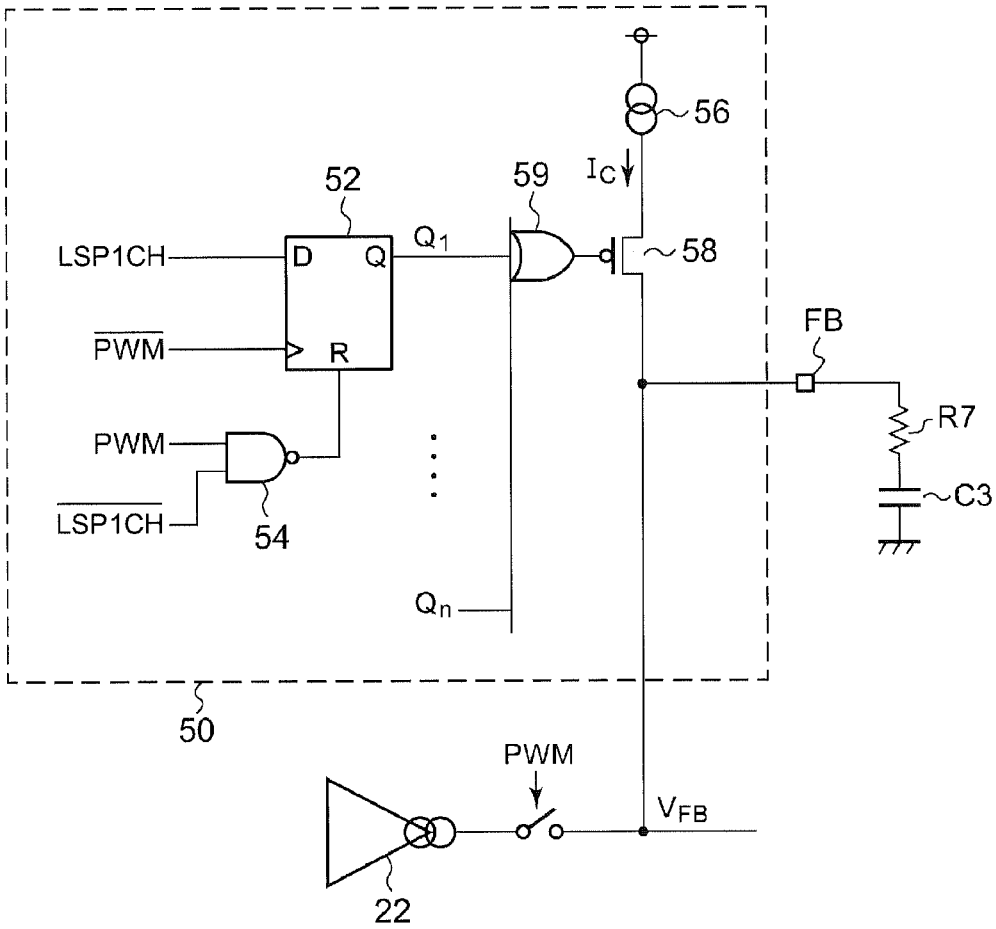
FIG. 3 is a circuit diagram showing a configuration example of a feedback voltage regulator circuit.

FIG. 3 is a circuit diagram showing a configuration example of the feedback voltage regulator circuit 50. The feedback voltage regulator circuit 50 includes a flipflop 52, an NAND gate 54, a current source 56, a switch 58, and an OR gate 59.

The current source 56 generates a current $I_C$ to be supplied to the phase compensation capacitor C3. The current $I_C$ is, for example, about 1 μA. The switch 58 is installed in the path of the current $I_C$, and an ON/OFF operation of the switch 58 corresponds to an ON/OFF operation of the feedback voltage regulator circuit 50. As the current $I_C$ is introduced into the phase compensation capacitor C3, the feedback voltage $V_{FB}$ is increased.

The flipflop 52 and the NAND gate 54 are installed at every channel of the LED strings (6). The short detection signal LSPiCH is input to an input terminal D of an ith flipflop 52, and an inverted signal $\overline{PWM}$ of the burst dimming pulse PWM is input to a clock terminal of the ith flipflop 52. Logical inverting is illustrated in the drawing.

The NAND gate 54 performs an NAND operation of the burst dimming pulse PWM and the inverted signal of the short detection signal LSPiCH. An output signal from the NAND gate 54 is input to a reset terminal of the flipflop 52.

The OR gate 59 performs an OR operation of output signals $Q_1$~$Q_n$ from the flipflop 52 of the respective channels, and supplies the result obtained through the OR operation. The switch 58 is turned on when an output signal from the OR gate has a low level and turned off when the output signal from the OR gate 59 has a high level.

Figure 4:
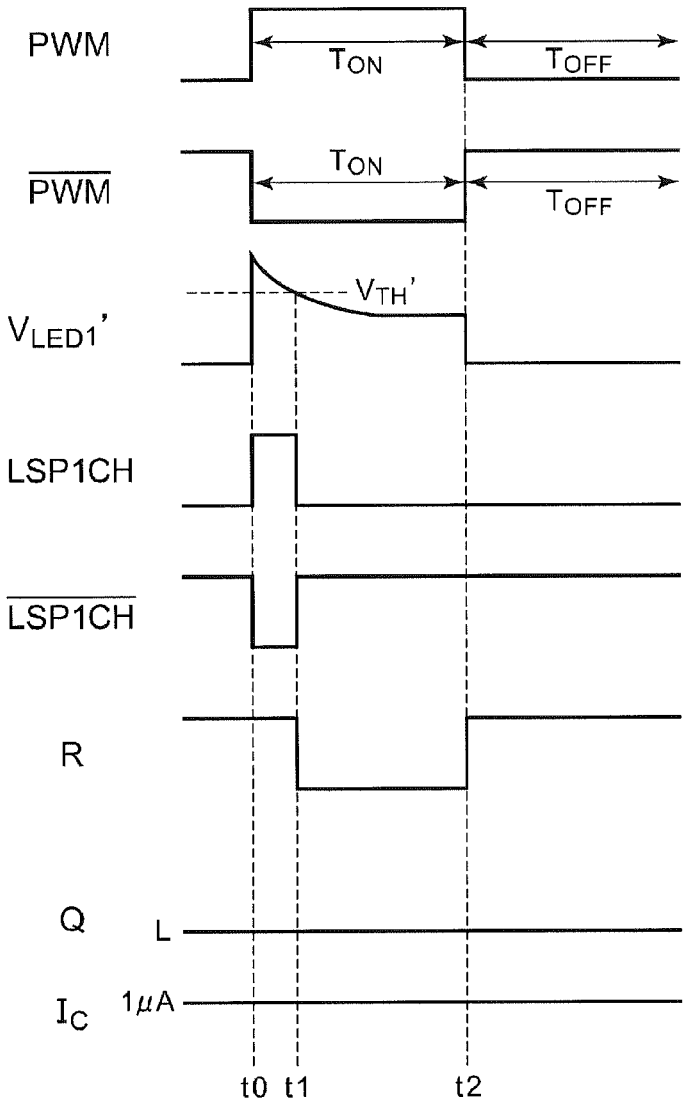
FIG. 4 is a time chart showing an operation of a control IC of FIG. 2.
Figure 5:
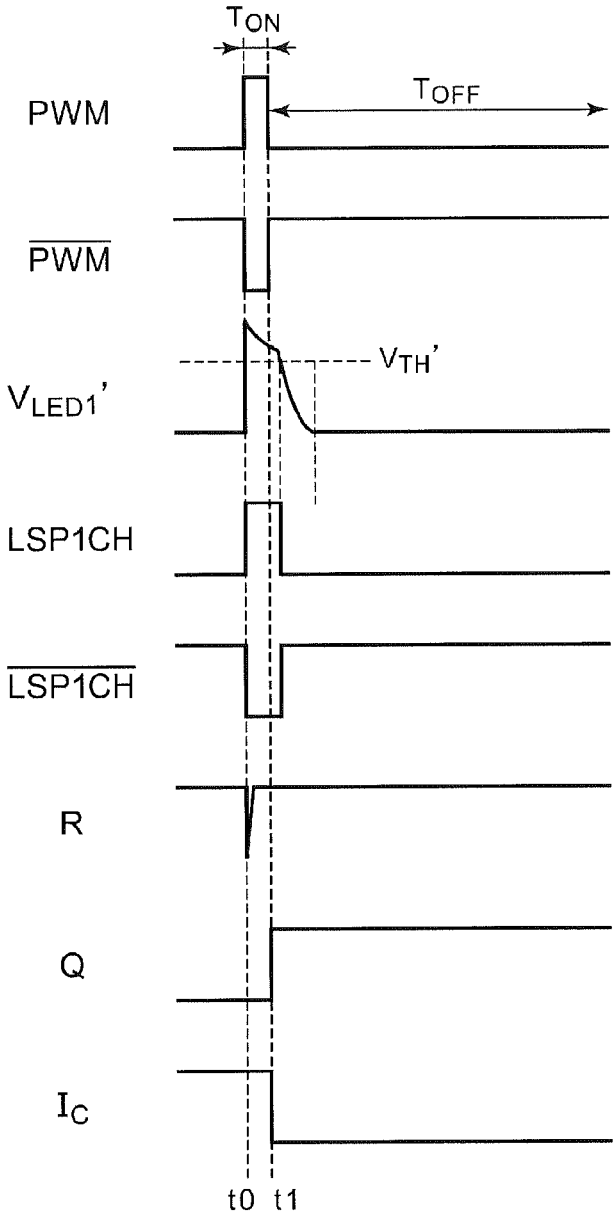
FIG. 5 is a time chart showing an operation of a control IC of FIG. 2.

The configuration of the control IC 100 has been described. An operation of the control IC 100 will now be described. FIG. 4 is a time chart when the pulse width of the burst dimming pulse PWM is somewhat long, and FIG. 5 is a time chart when the pulse width of the burst dimming pulse PWM is short.

First, with reference to FIG. 4, it is assumed that a burst dimming pulse PWM having a relatively long pulse width is repeatedly generated. In order to facilitate understanding and simplify explanation, only a first channel will be mainly described.

Before a time t0, the burst dimming pulse $PWM_1$ has a low level, so the current source $CS_1$ is in an OFF state and the LED string 6_1 is turned off. At this time, since the transistor 63 is turned off, a short detection is invalidated, and since the detection voltage $V_{LED'}$ has been pulled down to have a low level (ground voltage), LSP1CH has a low level.

When the burst dimming pulse $PWM_1$ transitions to have a high level at the time t0, the current source $CS_1$ is turned on and a driving current starts to flow to the LED string 6_1, and a voltage drop Vf of the LED string 6_1 is gradually increased from zero. The detection voltage $V_{LED1}$ is supplied as $V_{LED1}$=Vout−Vf, so it is gradually lowered over time. Immediately after the burst dimming pulse $PWM_1$ transitions to have a high level, the short detection signal LSP1CH has a high level in order to establish $V_{LED1'}>V_{TH'}$. At a time t1, when the detection voltage $V_{LED1'}$ is lower than a threshold voltage $V_{TH'}$, the short detection signal LSP1CH transitions to have a low level, and thereafter, is maintained at the low level.

At a timing when the burst dimming pulse $PWM_1$ transitions to have a low level at a time t2, the inverted short detection signal LSP1CH has a low level, so an output signal Q1 from the flipflop 52 has a low level, and then the output signal Q1 continues to have the low level during a turn-off period $T_{OFF}$ until such time as the burst dimming pulse $PWM_1$ transitions to have a high level at a time t3 (not shown).

The operations of the time t0 to t3 are repeated, and in order to maintain a control signal of the switch 58 at a low level, the switch 58, i.e., the feedback voltage regulator circuit 50, is kept in an ON state, so the injection current $I_C$ is continuously supplied to the phase compensation capacitor C3. In this manner, when the pulse width of the burst dimming pulse PWM is relatively long, the feedback voltage regulator circuit 50 is turned on. Since the current capability of the error amplifier 22 is sufficiently greater than the injection current Ic of the feedback voltage regulator circuit 50, it is barely affected by the injection current $I_C$.

With continuing reference to FIG. 5, at a time t0, the burst dimming pulse $PWM_1$ transitions to have a high level and the detection voltage $V_{LED1}$ is gradually lowered over time. When the pulse width of the burst dimming pulse PWM is shortened, the burst dimming pulse PWM transitions to have a low level (time t1) before the detection voltage $V_{LED1}$ becomes lower than the threshold value voltage $V_{TH}$, namely, before the short detection signal LSP1CH transitions to have a low level. Accordingly, the output signal Q1 from the flipflop 52 has a high level.

Here, in order to clarify the effect of the control IC 100 in FIG. 2, an operation without the feedback voltage regulator circuit 50 will be described.

When the pulse width of the burst dimming pulse $PWM_1$ is short, a response of the error amplifier 22 is delayed, insufficiently supplying a current to the phase compensation capacitor C3 from the error amplifier 22 to lower the feedback voltage $V_{FB}$. As a result, the ON time duration of the switching pulse signal Spwm is shortened to lower the driving voltage Vout. When the driving voltage Vout is lowered, the LED string 6 does not emit light.

An operation with the feedback voltage regulator circuit 50 will now be described. Although the response of the error amplifier 22 is delayed and a current supply to the phase compensation capacitor C3 from the error amplifier 22 is insufficient, since the injection current $I_C$ is supplied to the phase compensation capacitor C3 from the feedback voltage regulator circuit 50, restraining the feedback voltage $V_{FB}$ from being lowered or increasing the feedback voltage $V_{FB}$, the ON time duration of the switching pulse signal Spwm is lengthened. As a result, lowering of the driving voltage Vout can be restrained, so the LED string 6 can emit light.

In this respect, however, during the turn-off period $T_{OFF}$ thereafter, when the current $I_C$ is continuously supplied to the phase compensation capacitor C3, the feedback voltage $V_{FB}$ is continuously increased resulting in an excessively high output voltage Vout. Thus, when the pulse width of the burst dimming pulse PWM is short, the current Ic is interrupted upon transitioning to the turn-off period $T_{OFF}$, thereby restraining the output voltage Vout from being increased.

In this manner, in the control IC 100 according to this embodiment, lowering of the output voltage due to a delay in the response speed of the error amplifier 22 can be restrained, and thus, the LED string 6 can emit light.

So far, the present disclosure has been described based on the embodiment. The embodiment is merely illustrative and there may be various modifications in the respective components, respective processes, and combinations thereof. Hereinafter, such modifications will be described.

In the embodiment, the non-insulating type switching power source using an inductor has been described, but the present disclosure can also be applicable to an insulating type switching power source using a transformer.

In the embodiment, the electronic device has been described as an application of the light emitting device 3, but the purpose thereof is not particularly limited but may be applicable for lighting purposes or the like.

Also, in the present embodiment, the setting of the high level, low level, assert, and negate logical signals are taken as an example, and those may be appropriately inverted by an inverter or the like, so as to be freely switched.

According to the present disclosure in some embodiments, it is possible to stabilize an output voltage when a turn-on time of burst dimming is short.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and switches in the form of the embodiments described herein may be made without departing from the spirit of the disclosures. The accompanying claims and their equivalents are intended to cover such forms or modifications as would fall within the scope and spirit of the disclosures.

What is claimed is:

1. A driving circuit of a light emitting element comprising:

a switching power source configured to supply a driving voltage to a first terminal of the light emitting element to be driven; and a current driver connected to a second terminal of the light emitting element, the current driver configured to supply a driving current to the light emitting element while a burst dimming pulse is being asserted, wherein the switching power source comprises:

a capacitor in which a potential of one end is fixed;

an error amplifier configured to supply a current depending on a difference between a detection voltage generated from the second terminal of the light emitting element and a reference voltage to the capacitor;

a switch installed between an output terminal of the error amplifier and the capacitor and maintained in an ON state while the burst dimming pulse is being asserted;

a pulse generation unit configured to receive a feedback voltage generated in the capacitor and generate a switching pulse signal having a corresponding duty ratio;

a driver configured to drive a switching element of the switching power source based on the switching pulse signal; and a feedback voltage regulator circuit configured to be switched between ON and OFF states based on a pulse width of the burst dimming pulse and supply a current to the capacitor when in an ON state.

2. The driving circuit of claim 1, wherein the feedback voltage regulator circuit is turned on when the pulse width of the burst dimming pulse is longer than a predetermined threshold value, turned on while the burst dimming pulse is being asserted when the pulse width of the burst dimming pulse is shorter than the threshold value, and then turned off.

3. The driving circuit of claim 1, further comprising:

a short detection comparator configured to generate a short detection signal asserted when the detection voltage is higher than a predetermined threshold voltage, wherein the feedback voltage regulator circuit is turned off when the short detection signal is being asserted at a timing when the burst dimming pulse is negated.

4. The driving circuit of claim 3, wherein the feedback voltage regulator circuit comprises a flipflop having an input terminal to which the short detection signal is input and a clock terminal to which an inverted signal of the burst dimming pulse is input, and wherein an ON/OFF state of the feedback voltage regulator circuit is switchable depending on an output signal from the corresponding flip-flop.

5. The driving circuit of claim 3, wherein the feedback voltage regulator circuit is turned on when the short detection signal is asserted while the burst dimming pulse is being negated.

6. The driving circuit of claim 3, wherein the feedback voltage regulator circuit comprises:

an NAND gate configured to receive the burst dimming pulse and an inverted signal of the short detection signal; and a flipflop having an input terminal to which the short detection signal is input, a clock terminal to which an inverted signal of the burst dimming pulse is input, and a reset terminal to which an output signal from the NAND gate is input, wherein an ON/OFF state of the feedback voltage regulator circuit is switchable depending on an output signal from the corresponding flip-flop.

7. The driving circuit of claim 1, wherein the feedback voltage regulator circuit comprises a current source configured to supply a current to the capacitor when in an ON state.

8. A light emitting device comprising:

a light emitting element; and a driving circuit as described in claim 1, the driving circuit being configured to drive the light emitting element.

9. An electronic device comprising:

a liquid crystal panel; and a light emitting device as described in claim 8, the light emitting device being installed as a backlight of the liquid crystal panel.

* * * * *